US007537298B2

(12) United States Patent
Oshio et al.

(10) Patent No.: US 7,537,298 B2
(45) Date of Patent: May 26, 2009

(54) PRINTING APPARATUS, PRINTING METHOD, AND PROGRAM FOR BLACK PIGMENT AND DYE INK

(75) Inventors: Naomi Oshio, Kanagawa (JP); Minoru Teshigawara, Kanagawa (JP); Tetsuya Edamura, Kanagawa (JP); Satoshi Seki, Kanagawa (JP); Kiichiro Takahashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/896,073

(22) Filed: Jul. 22, 2004

(65) Prior Publication Data

US 2005/0024401 A1 Feb. 3, 2005

(30) Foreign Application Priority Data

Jul. 31, 2003 (JP) ..... 2003-284382

(51) Int. Cl.
*B41J 29/38* (2006.01)

(52) U.S. Cl. ..... 347/9; 347/14

(58) Field of Classification Search ..... 347/9, 347/14, 19; 399/306, 309, 364
See application file for complete search history.

(56) References Cited

U.S. PATENT DOCUMENTS

| | | | | |
|---|---|---|---|---|
| 6,012,809 | A * | 1/2000 | Ikeda et al. | 347/101 |
| 6,336,705 | B1 * | 1/2002 | Torigoe | 347/43 |
| 6,659,582 | B2 * | 12/2003 | Underwood | 347/14 |
| 2002/0080394 | A1 | 6/2002 | Ogasahara et al. | |
| 2005/0012764 | A1 * | 1/2005 | Kawakami | 347/5 |

FOREIGN PATENT DOCUMENTS

JP 7-314734 12/1995

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

According to the present invention, if an image is printed on both sides of a printing medium, the possibility of rubbing ink off from the printing medium is minimized to inhibit contamination of the printing medium and the interior of the printing apparatus, while maintaining the print grade of the image. Thus, if a double side print mode is executed in which an image is printed on both sides of the printing medium, then, for a particular image part, a ratio of an amount of black pigment ink used to an amount of black dye ink used is set so as to limit the amount of black pigment ink used and to compensate for a decrease in print density with the limited amount of the black pigment ink used.

8 Claims, 13 Drawing Sheets

| | BLACK PIGMENT INK | BLACK DYE INK |
|---|---|---|
| SETTING 1 | 1 DOT | —— |
| SETTING 2 | 0.75 DOTS | 0.10 DOTS |
| SETTING 3 | 0.30 DOTS | 0.35 DOTS |
| SETTING 4 | 0.15 DOTS | 0.60 DOTS |
| SETTING 5 | —— | 0.65 DOTS |

FIG.7

(a) PIGMENT INK (b) DYE INK (c) PIGMENT INK + DYE INK (a) PIGMENT INK (b) DYE INK (c) PIGMENT INK + DYE INK

PRINTING APPARATUS, PRINTING METHOD, AND PROGRAM FOR BLACK PIGMENT AND DYE INK

This application claims priority from Japanese Patent Application No. 2003-284382 filed Jul. 31, 2003, which is incorporated hereinto by reference.

BACKGROUND OF THE INVENTION

1. Field of the Invention

The present invention relates to a printing apparatus, a printing method, and a program, all of which enable an image to be printed on a printing medium using pigment and dye inks in the same color for at least one color on the basis of a print mode including at least a double side print mode in which both sides of a printing medium are printed.

The present invention is applicable to any equipment using various printing materials such as paper, leather, non-woven cloths, and metal. Specific applied equipment may include office equipment such as a printer, a copier, or a facsimile machine, or industrial production equipment.

2. Description of the Related Art

An ink jet printing system prints on a printing material by ejecting small droplets of ink to the printing material using any ink ejecting system such as an electrostatic suction system by applying high voltage, a system for mechanically vibrating or displacing ink (coloring ink) using a piezoelectric element or a system utilizing pressure generated when the ink bubbles as a result of heating. This printing system has the advantages of reducing noise generated during printing and increasing a resolution and a printing speed using a print head having densely integrated ink ejection openings. Printing apparatuses employing such an ink jet printing system are common in typical homes. The volume of domestic printing tends to increase. This is because the printing apparatus exhibits high performance sufficient to easily print photographs as beautiful as or more beautiful than silver halide photographs and because personal computers are common. Another reason is that more users use a home printing apparatus (printer) to print New Year's cards and browse and print Web pages with the improved Internet environment.

With such an increase in print volume, proportion of print cost in users' consumption increases. Accordingly, it has been more and more desirable to reduce print cost. Thus, there is a gradually growing demand for a printing apparatus that can reduce the used printing materials to half by printing both sides of the printing material (double side printing). Double side printing can also be effectively used for letter printing, a typical example of printing by general user.

An example of a patent document disclosing the double side print mode is Japanese Patent Application Laid-open No. 7-314734 (1995). Japanese Patent Application Laid-open No. 7-314734 (1995) has been proposed as measures for suppressing a show-through phenomenon that may occur during the double side printing, in which both sides of a printing medium are printed. Specifically, the show-through phenomenon is suppressed by reducing a print density in the double side print mode compared to a single side print mode.

Presently, an ink mainly composed of dye-based components (hereinafter referred to as a "dye ink") is considered to be more advantageously used to print an image having a photographic quality on an exclusive sheet such as surface treated coated paper. The dye ink can be generated by dissolving variable water-soluble dyes in water or a mixture of water and an organic solvent. However, the dye ink tends to exhibit a low print grade for ordinary paper. Accordingly, it is not suited for printing simple documents or Web pages, routinely used by users, on ordinary paper. This is because the dye of the dye ink is prone to permeate deep through fibers in the ordinary paper.

There is also a growing demand for improvement of the print grade for the ordinary paper, which is inexpensive. An ink mainly composed of pigment-based components (hereinafter referred to as a "pigment ink") exhibits a high print grade for the ordinary paper. The pigment ink can be generated by dissolving, in a water-soluble solvent, a pigment fluid dispersion composed of a pigment dispersed in a polymer dispersant. The pigment ink is advantageous in the print grade for the ordinary paper because grains of the coloring material are larger than those in the dye and thus do not easily permeate deep through the fibers in the ordinary paper but are likely to be collected in a front layer of the ordinary paper.

Presently, ink jet printing apparatuses are commercially available which use both the dye ink and the pigment ink in order to print images having a photographic quality, while improving the print grade for the ordinary paper. Many such ink jet printing apparatuses use the pigment ink as a black ink and the dye inks as color inks (cyan, magenta, and yellow inks including those with different ink densities).

As previously described, the pigment ink exhibits a higher print grade for the ordinary paper because the grains of the coloring material are larger than those in the dye and thus do not easily permeate deep through the fibers in the ordinary paper but are likely to be collected in a front layer of the ordinary paper. Thus, if the pigment ink is used to print an image, the resulting image has a high reflection density. Further, the pigment ink also does not permeate through the periphery of the printed image. This allows the boundary of the image and a character to be clearly printed. On the other hand, the grains of the coloring material of the pigment ink, which are larger than those in the dye ink, are settled near the front surface of the printed material. The pigment ink is easily rubbed off from the printed material even by slight friction. The probability that pigment molecules are present near the front surface of the printed material is increased, thus degrading abrasion resistance.

The degraded abrasion resistance of the pigment ink is particularly problematic if double side printing is executed on various printing materials including letters. This is because the double side printing involves a process of printing an image on one side of the printing material inside a printing apparatus, then turning the printing material upside down, and subsequently passing the printing material through the printing apparatus in order to print an image on the other side. During such double side printing, a portion printed using the pigment ink, having the degraded abrasion resistance, may be transferred to an internal part of the printing apparatus when passing through a mechanism structure part such as a conveying passage for the printing material which is provided inside the printing apparatus. The ink transferred to the internal part of the printing apparatus may adhere to contaminate the printing material. Further, when printing materials printed with images rub against each other, the pigment may simply be rubbed off to contaminate the printing materials.

To avoid the above problem, it is conceivable to reduce the amount of a black pigment ink used in a double side print mode for the double side printing. In this case, however, the decrease in the amount of the black pigment ink used reduces the optical reflection density of the printed image. Accordingly, it is conceivable to compensate for the optical reflection density by superimposing color (cyan, magenta, and yellow) dye inks on one another. However, the inventors found that the manner is not enough with respect to the following.

That is, compared to the black pigment ink, an insufficient optical reflection density results from a process black, expressed by superimposing the color (cyan, magenta, and yellow) dye inks on one another. Therefore, even if the amount of black pigment ink used in the double side print mode is reduced and an attempt is made to compensate for the accompanying decrease in density using the process black, the decrease cannot be sufficiently compensated for. As a result, even though the black pigment ink, exhibiting a high print grade, is used for the ordinary paper, the performance of the pigment may not be fully demonstrated, thus lowering the print grade. Moreover, when the color dye inks are superimposed on each other in order to express the process black, a large amount of ink impacts the printing material, so that the ink may permeate through the printing material to its back side to cause the show-through phenomenon. Thus, the grade of the back side of the printing material, which is to be printed next, may lower before printing or a decrease in print grade called migration may occur. These problems may dissatisfy users.

SUMMARY OF THE INVENTION

The present invention can provide a printing apparatus, a printing method, and a program, all of which operate if an image is printed on both sides of a printing medium, to minimize the possibility of rubbing ink off from the printing medium to inhibit contamination of the printing medium and the interior of the printing apparatus, while maintaining the print grade of the image.

In the first aspect of the present invention, there is provided a printing apparatus capable of printing an image on a printing medium by using at least pigment and dye inks in the same color, the apparatus comprising:

print control means capable executing a single side print mode in which one side of the printing medium is printed and a double side print mode in which both sides of the printing medium are printed, wherein when the double side print mode is executed, the print control means executes a process for decreasing an amount of the pigment ink in a predetermined color used compared to the single side print mode, and for increasing an amount of the dye ink in the predetermined color used so as to compensate for a decrease in print density with the decreased amount of the pigment ink in the predetermined color used.

In the second aspect of the present invention, there is provided a printing apparatus capable of printing an image on a printing medium by using at least pigment and dye inks in the same color, the apparatus comprising:

print control means capable of executing a single side print mode in which one side of the printing medium is printed and a double side print mode in which both sides of the printing medium are printed, wherein the print control means sets, for a particular image part, a ratio of an amount of the pigment ink in the same color used to an amount of the dye ink in the same color used, so as to limit the amount of the pigment ink in the same color used and to compensate for a decrease in print density with the limited amount of the pigment ink in the same color used, and the particular image part is an image part to be printed by using the pigment ink in the same color with respect to at least a surface of both surfaces of the printing medium, the surface being first printed, when the double side print mode is executed.

In the third aspect of the present invention, there is provided a printing method capable of printing an image on a printing medium by using at least pigment and dye inks in the same color, the method comprising the steps of:

a selecting step of selecting either a single side print mode in which one side of the printing medium is printed or a double side print mode in which both sides of the printing medium are printed; and a printing step of, when the double side print mode is selected by the selecting step, executing printing so that an amount of the pigment ink in a predetermined color used is decreased compared to the single side print mode, and an amount of the dye ink in the predetermined color used is increased so as to compensate for a decrease in print density with the decreased amount of the pigment ink in the predetermined color used.

In the fourth aspect of the present invention, there is provided a printing method capable of printing an image on a printing medium by using at least pigment and dye inks in the same color, the method comprising the steps of:

a selecting step of selecting either a single side print mode in which one side of the printing medium is printed or a double side print mode in which both sides of the printing medium are printed; and a setting step of setting, for a particular image part, a ratio of an amount of the pigment ink in the same color used to an amount of the dye ink in the same color used, so as to limit the amount of the pigment ink in the same color used and to compensate for a decrease in print density with the limited amount of the pigment ink in the same color used, wherein the particular image part is an image part to be printed by using the pigment ink in the same color with respect to at least a surface of both surfaces of the printing medium, the surface being first printed, when the double side print mode is selected by the selecting step.

In the fifth aspect of the present invention, there is provided a program for producing image data supplied to a printing apparatus which is capable of printing an image on a printing medium by using at least pigment and dye inks in the same color, the program having a computer execute the step of:

a producing step of producing image data in accordance with a selected one of a single side print mode in which one side of the printing medium is printed and a double side print mode in which both sides of the printing medium are printed, wherein the creating step includes:

a setting step of setting, for a particular image part, a ratio of an amount of the pigment ink in the same color used to an amount of the dye ink in the same color used, so as to limit the amount of the pigment ink in the same color used and to compensate for a decrease in print density with the limited amount of the pigment ink in the same color used; and a step of producing image data on the basis of the ratio set by the setting step, wherein the particular image part is an image part to be printed by using the pigment ink in the same color with respect to at least a surface of both surfaces of the printing medium, the surface being first printed, when the double side print mode is selected.

According to the present invention, if a pigment ink and dye ink in the same color are used to print an image on both sides of a printing medium, the amount of pigment ink in the same color is limited, while the decrease in print density with the limited amount of pigment ink is compensated by using the dye ink in the same color. Thus, the possibility of rubbing ink off from the printing medium is minimized while maintaining the print grade of the image, thus enabling the inhibition of contamination of the printing medium and the interior of the printing apparatus.

The above and other objects, effects, features and advantages of the present invention will become more apparent from the following description of embodiments thereof taken in conjunction with the accompanying drawings.

BRIEF DESCRIPTION OF THE DRAWINGS

FIG. 7 is a diagram illustrating an example of the setting of the ink used according to the first embodiment of the present invention;

DETAILED DESCRIPTION OF PREFERRED EMBODIMENTS

Embodiments of the present invention will be described below with reference to the drawings.

First Embodiment

Figure 1:
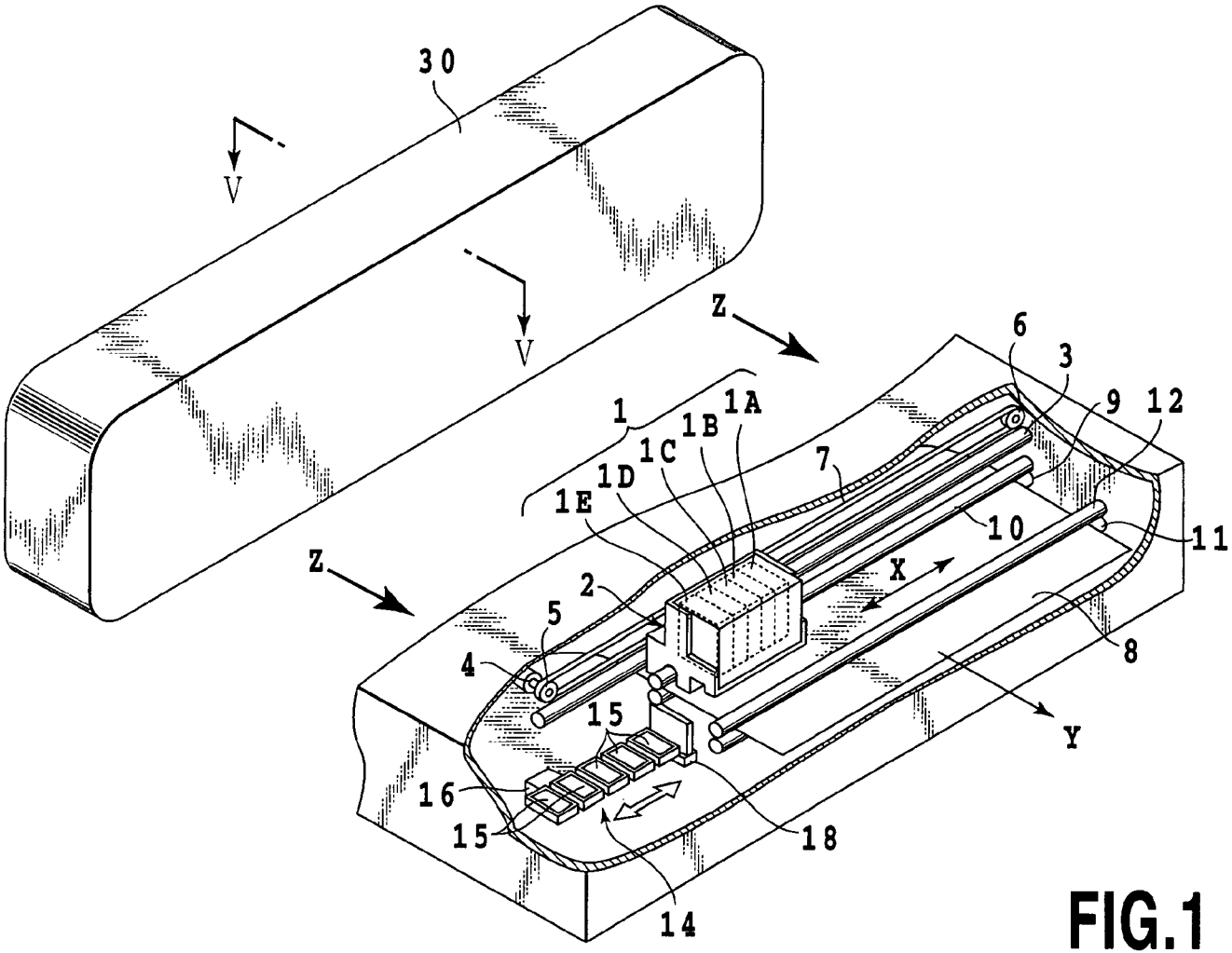
FIG. 1 is partly cutout perspective view schematically showing an ink jet printing apparatus to which the present invention is applicable.

FIG. 1 is partly cutout perspective view schematically showing an ink jet printing apparatus to which the present invention is applicable.

In FIG. 1, reference numeral 1 denotes an ink jet cartridge integrally including a print head section and an ink tank section. In the present example, five ink jet cartridges 1A, 1B, 1C, 1D, and 1E are interchangeably mounted on a carriage 2. The ink tank section accommodates ink. The print head section can eject ink supplied by the ink tank section, from ink ejection openings. Each of the cartridges 1A to 1E is provided with a connector used to receive driving signals for the print head section. In the description below, all or any one of the cartridges 1A to 1E, operating as printing means, is also called a cartridge 1.

Figure 2:
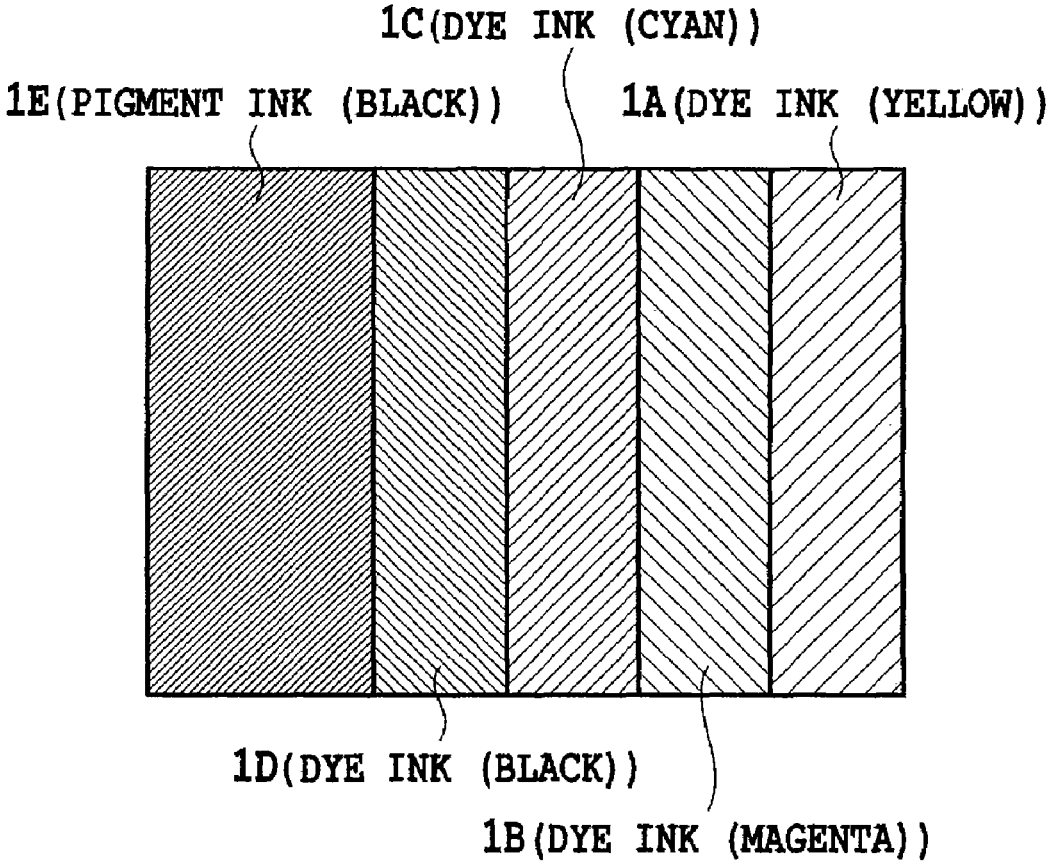
FIG. 2 is a diagram illustrating ink used for an ink jet cartridge according to a first embodiment of the present invention.

The plurality of cartridges 1 execute printing using ink in different colors. The ink tank sections house different types of inks, for example, cyan, magenta, yellow, and black. The ink tank sections can house plural types of inks regardless of whether the ink is composed of pigment or dye. In the present invention, it is necessary to house a pigment ink and a dye ink in the same color. In the present example, as shown in FIG. 2, the ink tank section of the cartridge 1D accommodates black dye ink. The ink tank section of the cartridge 1E accommodates a black pigment ink. The cartridges 1A, 1B, and 1C accommodate yellow, magenta, and cyan dye inks, respectively. These cartridges 1 are interchangeably mounted at respective specified positions on the carriage 2. The carriage 2 is provided with connector holders (electric connections) used to transmit driving signals or the like to the connectors of the respective cartridges 1.

The carriage 2 is guided so as to be movable in a main scanning direction shown by an arrow X, along a guide shaft 3 installed in an apparatus main body. The movement of the carriage 2 is controlled by the driving force of a main scanning motor 4 via a motor pulley 5, an idler pulley 6, and a timing belt 7. Two pairs of conveying rollers 9, 10 and 11, 12 are rotated to convey (paper feed) a printing material 8 such as a sheet or a thin plastic plate through a position (a printing section) opposite to the print head section of the cartridge 1 (hereinafter also simply referred to as the "print head 1"). The printing material 8 has its back side supported by a platen (not shown) so as to form a flat print surface in the printing section.

Each cartridge 1 mounted on the carriage 2 is held so that an ejection opening surface (a surface in which the ink ejection openings are formed) of the print head section projects downward from the carriage 2. The ejection opening surface lies parallel with the front surface of the printing material 8 between the conveying rollers 9 and 10 and the conveying rollers 11 and 12. An automatic reversing device 30 for double side printing is mounted in the rear part of the apparatus main body. The automatic reversing device 30 is externally mounted in the ink jet printing apparatus to automatically reverse the printing material 8 as described later.

The printing apparatus sequentially prints images in a print area on the printing material 8 by repeating an operation of ejecting ink from the print head 1 while moving the print head 1 in the main scanning direction together with the carriage 2 and an operation of conveying the printing material 8 in a sub-scanning direction.

Reference numeral 14 denotes a recovery processing section that executes a recovery process to keep the print head 1 properly ejecting ink. The recovery processing section 14 comprises caps 15 that can cap the ejection opening surface of the print head 1 and a wiper blade 18 that can wipe the ejection opening surface of the print head 1. A suction pump 16 is connected to the cap 15 to introduce a negative pressure into the caps 15 capping the ejection opening surface of the print head 1. This makes it possible to suck and discharge ink not contributing to the printing of an image, from the ejection openings in the print head 1 (a suction recovery process). It is also possible to eject the ink not contributing to the printing of an image, into the caps 15 through the ejection openings (preliminary ejection) or to pressurize the ink in the print head 1 to discharge the ink not contributing to the printing of an image, into the caps 15 through the ejection openings (pressure recovering process).

The print head 1 constitutes ink jet printing means for ejecting the ink from the ink ejection openings using various ejecting systems. In the present example, the print head 1 comprises an electrothermal converter to eject the ink utilizing thermal energy. Specifically, thermal energy from the electrothermal converter is used to cause film boiling in the ink. Then, bubbles grow and contract to vary the pressure exert on the ink. This variation is utilized to eject the ink from the ejection openings. The print head 1 may use a system that causes the ink to be ejected using a piezoelectric element.

Figure 3:
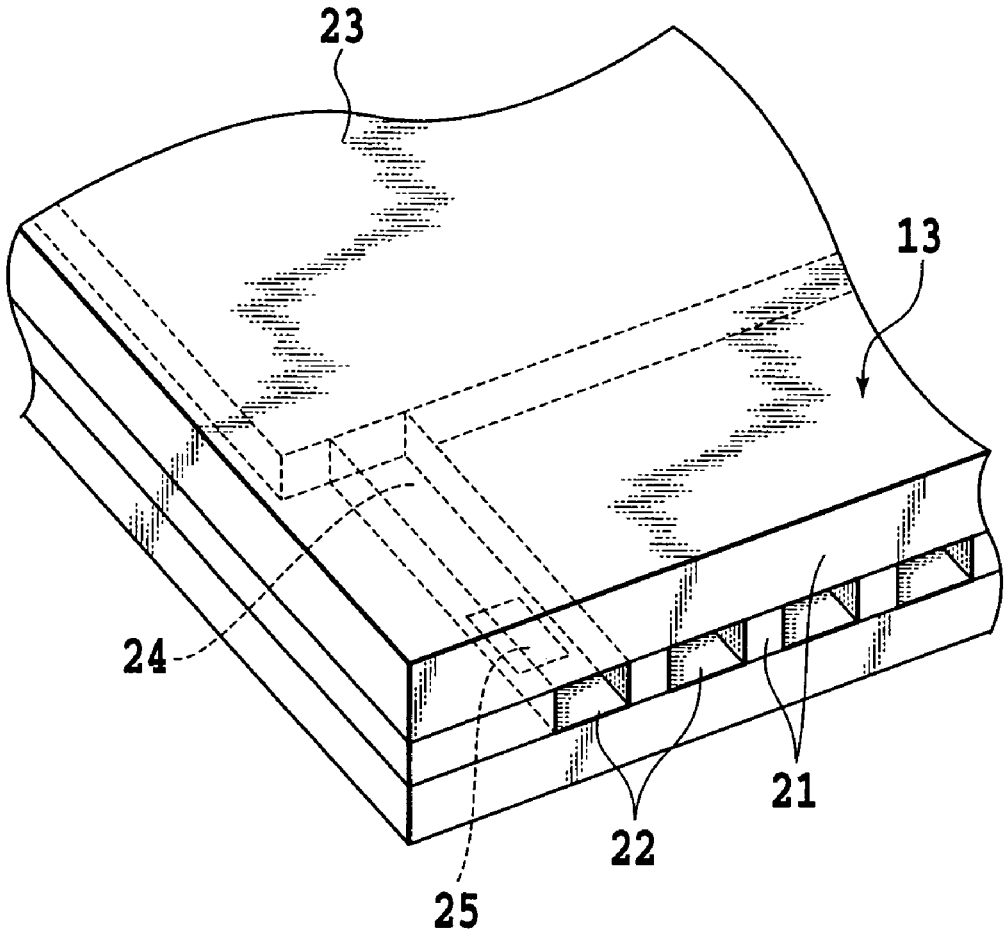
FIG. 3 is a schematic perspective view of an essential part of a print head in FIG. 1.

FIG. 3 is a schematic perspective view showing the configuration of an essential part of an ink ejecting section 13 of the print head 1.

The ink ejecting section 13 is formed with an ejection opening surface 21 that faces the printing material 8 so that there is a predetermined clearance (about 0.5 to 2 [mm]) between the ejection opening surface 21 and the printing material 8. The ejection opening surface 21 is formed with a plurality of ejection openings 22 at a predetermined pitch. Each of the ejection openings 22 is in communication with a common liquid chamber 23 through a corresponding channel 24. The interior of the common liquid chamber 23 is supplied with ink from the corresponding ink tank section. An electrothermal converter (heating resistor) 25 is disposed on a wall surface of each channel 24 to generate thermal energy for ink ejection. The ejection openings 22 in the print head 1 are arranged in the sub-scanning direction (the direction crossing the main scanning direction shown by an arrow X) shown by an arrow Y in FIG. 1. On the basis of an image signal or an ejection signal, the corresponding electrothermal converter (hereinafter referred to as a "heater") 25 is driven (energized) to cause film boiling in the ink in the channel 24. Then, the resultant pressure causes the ink to be ejected from the ejection opening 22.

Figure 4:
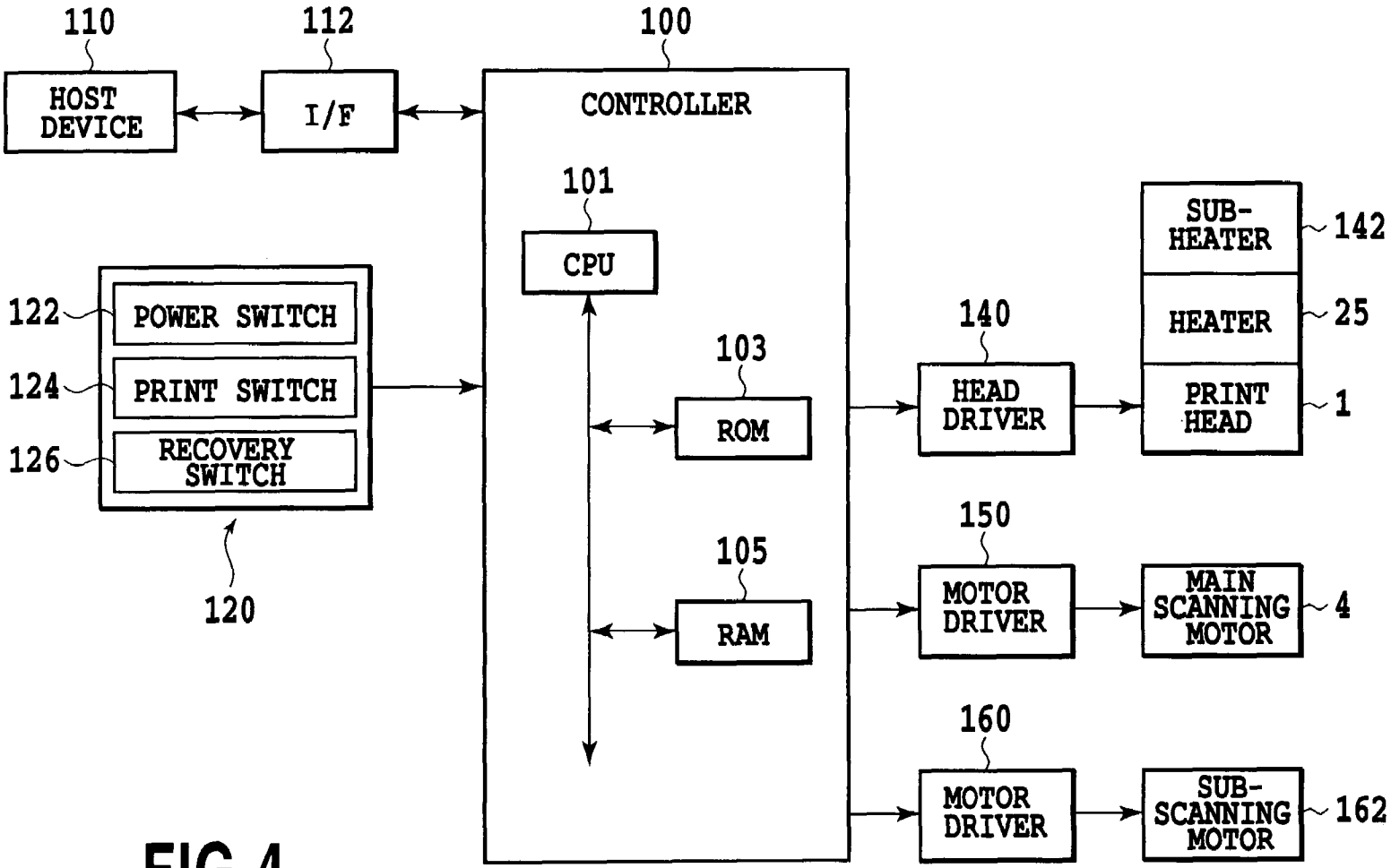
FIG. 4 is a block diagram of the configuration of a control system of the ink jet printing apparatus in FIG. 1.

FIG. 4 is a block diagram showing an example of the configuration of a control system of the ink jet printing apparatus in FIG. 1.

In FIG. 4, reference numeral 100 denotes a controller operating as a main control section. The controller 100 includes, for example, a CPU 101 in a microcomputer form, a ROM 103 that stores programs, required tables, and other fixed data, and a RAM 105 provided with areas in which image data is expanded, work areas, and the like. A host device 110 supplies image data to the printing apparatus and may be formed as a computer that, for example, creates or processes image data, a reader section that reads data, or the like. Image data, commands, status signals, and the like are transmitted between the host device 110 and the controller 100 via an interface (I/F) 112. An operating section 120 comprises a group of switches that receives instruction inputs by an operator. The operating section 120 has a power switch 122, a print switch 124 that instructs on the start of printing, and a recovery switch that instructs on the activation of the previously described suction recovery.

A head driver 140 drives the heater 25 in the print head 1 in accordance with print data or the like. The head driver 140 has, for example, a shift register that aligns print data in association with the position of the heater 25, a latch circuit that latches the print data using an appropriate timing, a logic circuit element that activates the heater 25 synchronously with a driving timing signal, and a timing setting section that appropriately sets a driving timing (ink ejection timing) for adjusting the positions at which ink dots are formed. The print head 1 is provided with a sub-heater 142. The sub-heater 142 adjusts temperature so as to stabilize the ink ejection characteristic of the print head 1. Like the heater 25, the sub-heater 142 may be formed on the substrate of the head 1 or attached to the print head 1. A motor driver 150 drives the main scanning motor 4. A sub-scanning motor 162 is a driving source that conveys the printing material 8 in the sub-scanning direction and that is driven by a motor driver 160.

Figure 5:
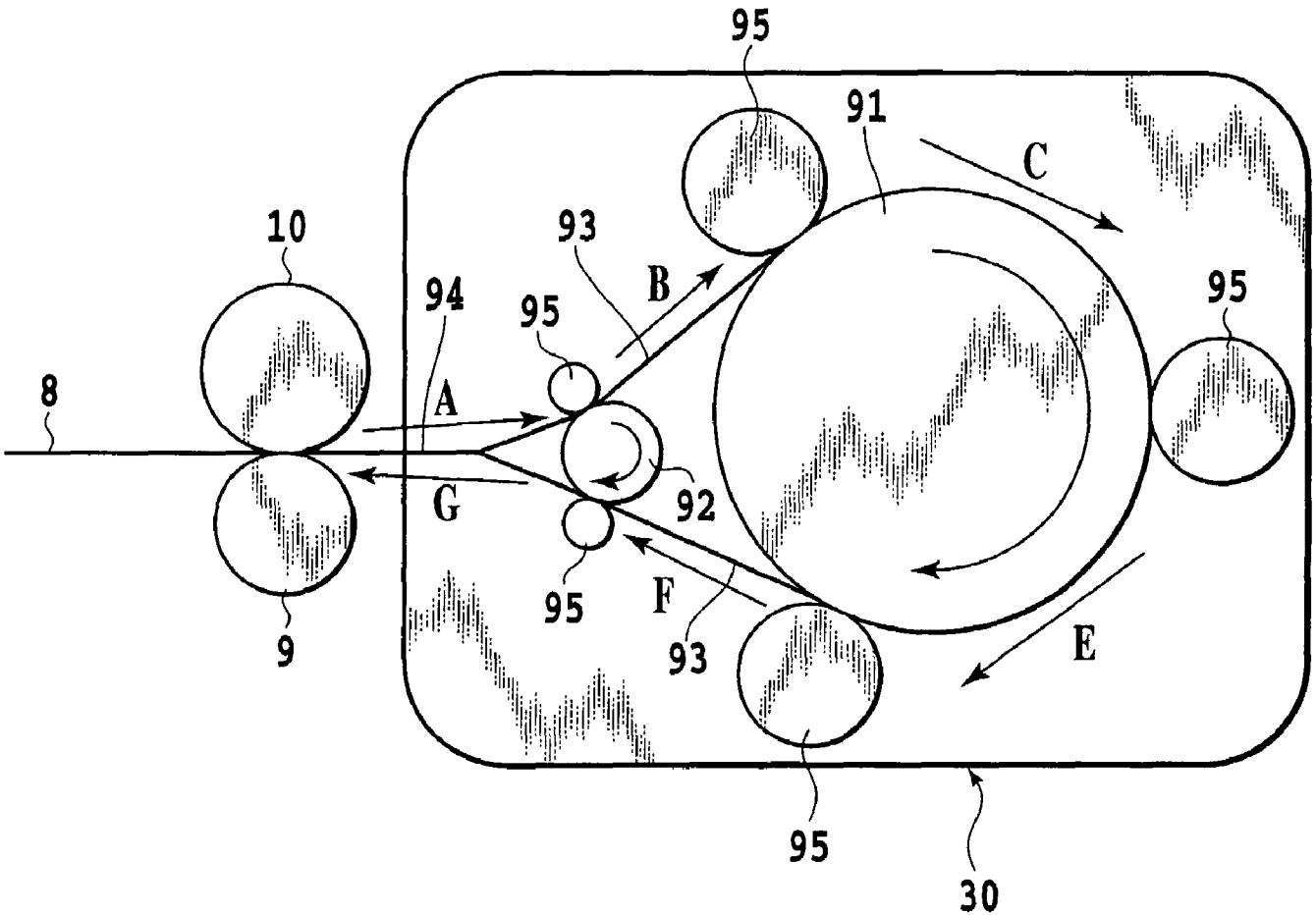
FIG. 5 is a schematic sectional view of an automatic reversing device taken along a line V-V in FIG. 1.

FIG. 5 is a sectional view of the automatic reversing device 30 taken along a line V-V in FIG. 1. Mounting the automatic reversing device 30 to the printing apparatus allows it to constitute an automatic double side printing apparatus. The printing apparatus is not limited to the use of such the external automatic reversing device 30 but may contain an arrangement that can execute double side printing.

The automatic reversing device 30 is mounted to the printing apparatus from a direction Z in FIG. 1 and functions in unison with the internal mechanism of the printing apparatus. The device 30 comprises a paper feeding conveying passage 94, a plurality of paper presser rollers 95, a reversing small roller 92, a looped reversing conveying passage 93, and a reversing large roller 91. The conveying roller 9 in the printing apparatus can be rotatively driven forward and backward by the motor. The printing material 8 is fed from a paper feeding section (not shown) to the interior of the printing apparatus through a forward feeding operation of the conveying rollers 9 and 10. Then, the printing material 8 is intermittently conveyed in the sub-scanning direction, while having one side (front surface) of it sequentially printed by the print head 1 with an image. Subsequently, the conveying rollers 9 and 10 perform the opposite feeding operation to feed the printing material 8 from the direction of an arrow A into the reversing conveying passage 93. The printing material 8 is sequentially conveyed in the directions of arrows A, B, C, E, F, and G and is thus turned upside down.

Specifically, the printing material 8 fed from the direction of the arrow A into the reversing conveying passage 93 is first fed in the direction of the arrow B while being sandwiched between the reversing small roller 92, which rotates in the clockwise direction of FIG. 5, and paper presser roller 95. Then, the printing material 8 is fed in the directions of the arrows C, E, and F while being sandwiched between the reversing large roller 91, which rotates in the clockwise direction of FIG. 5, and the plurality of (in the present example, three) paper presser rollers 95. Subsequently, the printing material 8 is fed in the direction of the arrow G while being sandwiched between the reversing small roller 92, which rotates in the clockwise direction of FIG. 5, and paper presser roller 95. Thus, the printing material 8 is turned upside down before being conveyed into the printing apparatus. The printing apparatus uses the print head 1 to print an image on the back surface of the printing material 8. The printing apparatus can supply a driving force to the reversing large roller 91 and the reversing small roller 92.

Such an operation of reversing the printing material 8 may be replaced with the user's assisting operation. Specifically, after the printing of the front surface of the printing material 8 has been finished, the user may turn the printing material 8 upside down and then reinsert it into an auto sheet feeder (not shown). The printing material 8 reinserted into the auto sheet feeder is conveyed into the printing apparatus again. Then, the back surface of the printing material 8 is printed.

The print mode of the printing apparatus includes a single side print mode in which the front surface of the printing material 8 is printed and a double side print mode in which both front and back surfaces of the printing material 8 are printed. In the double side print mode, the automatic reversing device 30 or the user reverses the printing material 8 as described above.

Figure 6:
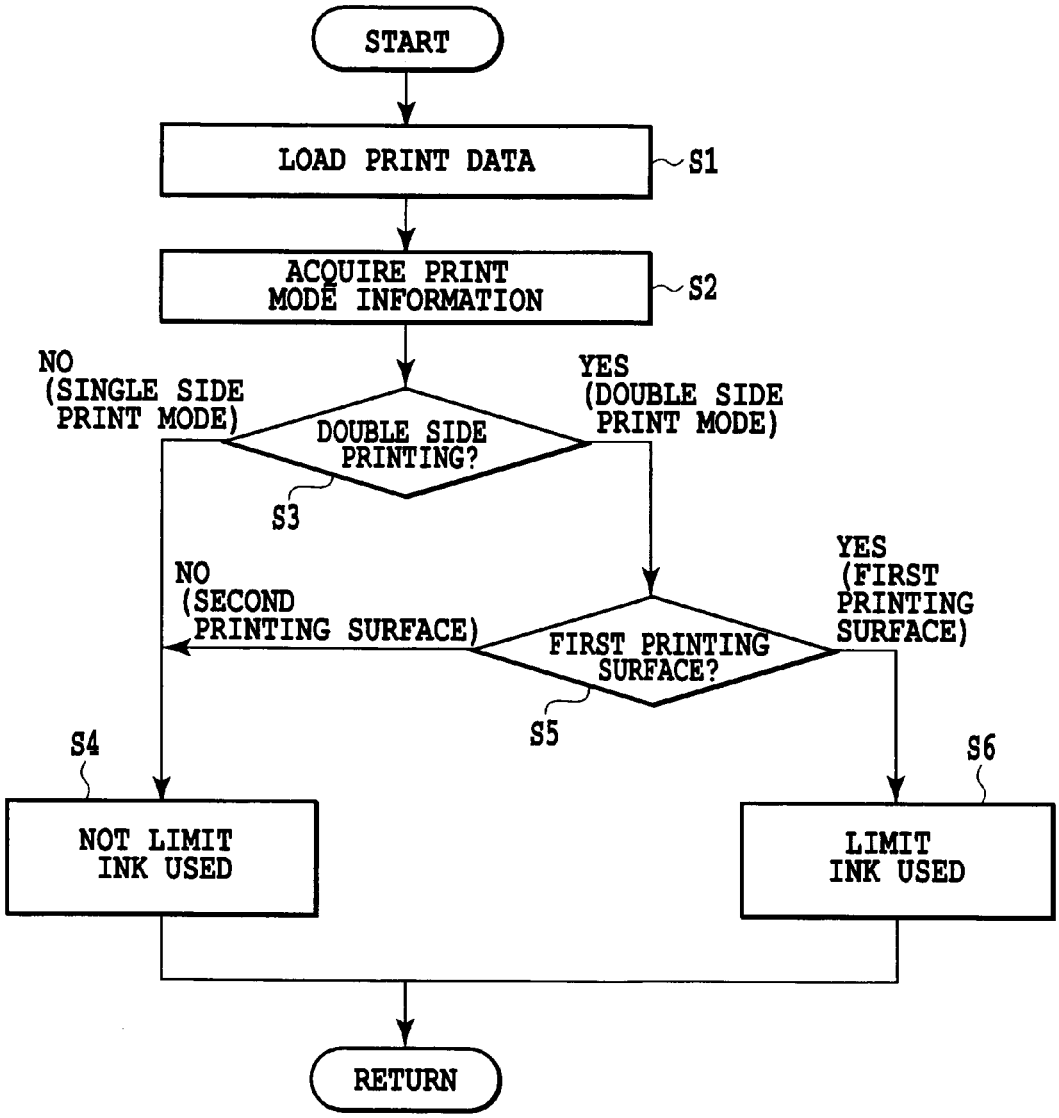
FIG. 6 is a flow chart illustrating a process of setting ink used according to the first embodiment of the present invention.

FIG. 6 is a flow chart illustrating a process of setting ink used, for the single side printing mode and the double side print mode.

First, at a step S1, data to be printed is loaded. Then, at a step S2, information on the print mode to be implemented is acquired from header information or the like accompanying the print data. Then, at a step S3, on the basis of the information on the print mode acquired in the step S2, it is determined whether or not the print mode to be implemented is for double side printing. If the print mode is not for double side printing, it is determined to be for single side printing. In the single side print mode, the amount of ink used for printing is not limited (step S4). Correspondingly, in the single side print mode, a black pigment ink, a black dye ink, and color (yellow, magenta, and cyan) dye inks are appropriately used in accordance with the image to be printed. Thus, only the black pigment ink, only the black dye ink, only one of the color dye inks, or any two or more of them may be used. For example, if in accordance with the printed image, the black pigment ink is to be used to form one dot per unit pixel (a predetermined print area), that dot is formed using only the black pigment ink as shown by a setting 1 in FIG. 7.

On the other hand, if the print mode is determined to be for double side printing in the step S3, it is determined whether or not the first printing surface (front side) of the printing material is to be printed (step S5). If the second printing surface (backside) of the printing material is to be printed, the process proceeds to a step S4. Then, as in the case of the single side print mode, the amount of ink used for the printing is not limited. On the other hand, if the front side of the printing material is to be printed, the amount of ink used for the printing is limited (step S6). That is, the amount of black pigment ink used is limited, and a decrease in the optical reflection density of the printed image, with the limited amount of black pigment ink used, is compensated by using the black dye ink.

Specifically, the amount of black pigment ink used is limited by selecting any of the settings 2 to 5 in FIG. 7 depending on the type of the printing material or the like. Further, the amount of black dye ink used is set so as to compensate for the accompanying decrease in print density with the limited amount of black pigment ink. With the setting 2, for a predetermined unit pixel on which one dot is supposed to be formed using the black pigment ink, the black pigment ink is used to form 0.75 dots, while the black dye ink is used to form 0.10 dots. In this manner, the amount of black pigment ink used is limited, and the amount of black dye ink used is set so as to compensate for the accompanying decrease in print density with the limited amount of black pigment ink used. With the settings 3 and 4, the amount of black pigment ink used is further limited and the amount of black dye ink used is increased so as to compensate for the accompanying decrease in print density. With the setting 5, the black pigment ink is not used, but only the black dye ink is used.

The numerical values shown in FIG. 7 indicate the number of dots per unit pixel, as converted from the amount of ink used per area in order to express a predetermined density level. The numerical values do not mean that the number of dots shown in the figure simply impact the printing material regardless of the density level of the image. Specifically, with the setting 1, to express the predetermined density level of image data, one dot impacts the predetermined unit pixel area. When a density level lower than the predetermined one is to be expressed, a fraction of one dot impacts the predetermined unit pixel area.

In this manner, when the first printing surface (front side) of the printing material is printed in the double side print mode, the amount of ink used for printing is limited in step S6. Subsequently, when the second printing surface (back side) of the printing material is printed, the amount of ink used for printing is not limited.

As described above, when the front side of the printing material is printed in the double side print mode, the amount of black pigment ink used is limited, and the black dye ink is used so as to compensate for the accompanying decrease in print density with the limited amount of black pigment ink used. The reason will be described below.

If double side printing is executed, the front side of the printing material, on which the image is first printed, is contacted with and rubbed by components of the automatic reversing device 30, the conveying roller 9, or the like. If the front side of the printing material is susceptible to abrasion, when pigment ink, having a low abrasion resistance, is used for the front side, that pigment is likely to be rubbed off. Specifically, the pigment grains of the pigment ink are larger than dye grains and thus do not easily permeate deep through fibers in a printing medium such as ordinary paper. Accordingly, the pigment grains are accumulated near the front surface of the printing medium and are thus likely to be rubbed off when contacted with the rollers or the like. When the pigment is rubbed off, not only the printing material but also the interior of the apparatus are contaminated. Moreover, when another printing material to be printed next contacts with the interior of the apparatus, pigment grains may be transferred to the printing material, resulting in secondary contamination.

On the other hand, the dye of a dye ink easily permeates deep through the fibers in the printing material and is thus unlikely to be rubbed off even when contacted with the rollers or the like. Thus, in the present embodiment, when the front side of the printing material is printed in the double side print mode, the amount of black pigment ink used is limited, and the black dye ink is used so as to compensate for the accompanying decrease in print density with the limited amount of black pigment ink used.

Additionally, when the back side of the printing material is printed in the double side print mode, the amount of black pigment ink used is not limited for the following reason.

After an image has been printed on the back side of the printing material, the operation of reversing the printing material is no longer performed. Accordingly, the back side is not rubbed by the reversing roller and is less likely to undergo ink rub-off than the front side. Thus, it is expected that ink rub-off, which may affect the image grade, is unlikely to occur even if the pigment ink is used without limitation on its amount. Accordingly, when the back side of the printing material is printed, the amount of ink used is not limited.

Additionally, when the front side of the printing material is printed in the double side print mode, the black dye ink is used to compensate for a decrease in print density resulting from the limitation of the amount of black pigment ink used, for the following reason.

The black dye ink is in the same color as that of the black pigment ink and can thus provide an optical reflection density close to that of the black pigment ink compared to dye inks in other colors. Thus, the black dye ink can be used to sufficiently compensate for a decrease in density resulting from a reduction in the amount of black pigment ink used. This serves to suppress a decrease in print grade. If an attempt is made to use the process black, expressed by superimposing the color (cyan, magenta, and yellow) dye inks on one another, to compensate for a decrease in density resulting from a reduction in the amount of black pigment ink used, the decrease in density cannot be adequately compensated for because the process black does not have a sufficient optical reflection density compared to the black pigment ink. Furthermore, to express the process black, a large amount of ink impacts the printing material through the superimposition of the color dye inks on one another. This may result in a decrease in print grade called migration, or a show-through phenomenon in which the ink permeates through to the back side of the printing material. Consequently, the grade of the back side of the printing material, which is to be printed next, may be lowered before printing.

Furthermore, as the settings 2 to 5 in FIG. 7, the limitation on the amount of ink used is varied in accordance with the type of the printing material or the like for the following reason.

The combination of the type of the printing material and the type of the pigment ink or the like determines the degree of the accumulation of the pigment of the pigment ink near the surface of the printing material and the degree of the rub-off of the pigment resulting from contact with the rollers or the like. The combination of the type of the printing material and the type of the dye ink or the like determines the degree of permeation of the dye of the dye ink deep through the printing material. In view of these circumstances, the limitation on the ink used can be selectively set. For example, if the printing material is a letter, the setting 3 in FIG. 7 is selected when an image is printed on the front side of the printing material. This prevents the ink from being rubbed off and suppresses a decrease in print density. Therefore, a high-grade image can be printed.

According to the first embodiment, described above, when in the double side print mode, an image is printed on the front side of the printing material, which may be rubbed after the image has been printed, the amount of black pigment ink used is limited, and the black dye ink is used to compensate for an accompanying decrease in print density resulting from a reduction in the amount of black pigment ink used. Furthermore, the amount of ink used is not limited when an image is printed on the back side. This makes it possible to print a high-grade image on each side of the printing material, while inhibiting the ink from being rubbed off and suppressing a decrease in print density. That is, it is possible to accomplish printing without causing the grade of one of the two printing surfaces to decrease below that of the other in the double side print mode. The decrease in print grade means defects in the image such as contamination with extra pigment ink, bleeding, and a decrease in the optical reflection density of the image.

When a decrease in the optical reflection density of the printed image resulting from the limitation on the amount of black pigment ink used is compensated for by using the black dye ink, dye inks in other colors are desirably used provided that this improves the print grade. Furthermore, header information is typically provided at the leading end of the print data. Thus, the inks used on the first and second printing surfaces can be independently set in accordance with the header information or the like.

Second Embodiment

In the present embodiment, in the double side print mode, the amounts of inks used for the first and second printing surfaces are equally limited.

Figure 8:
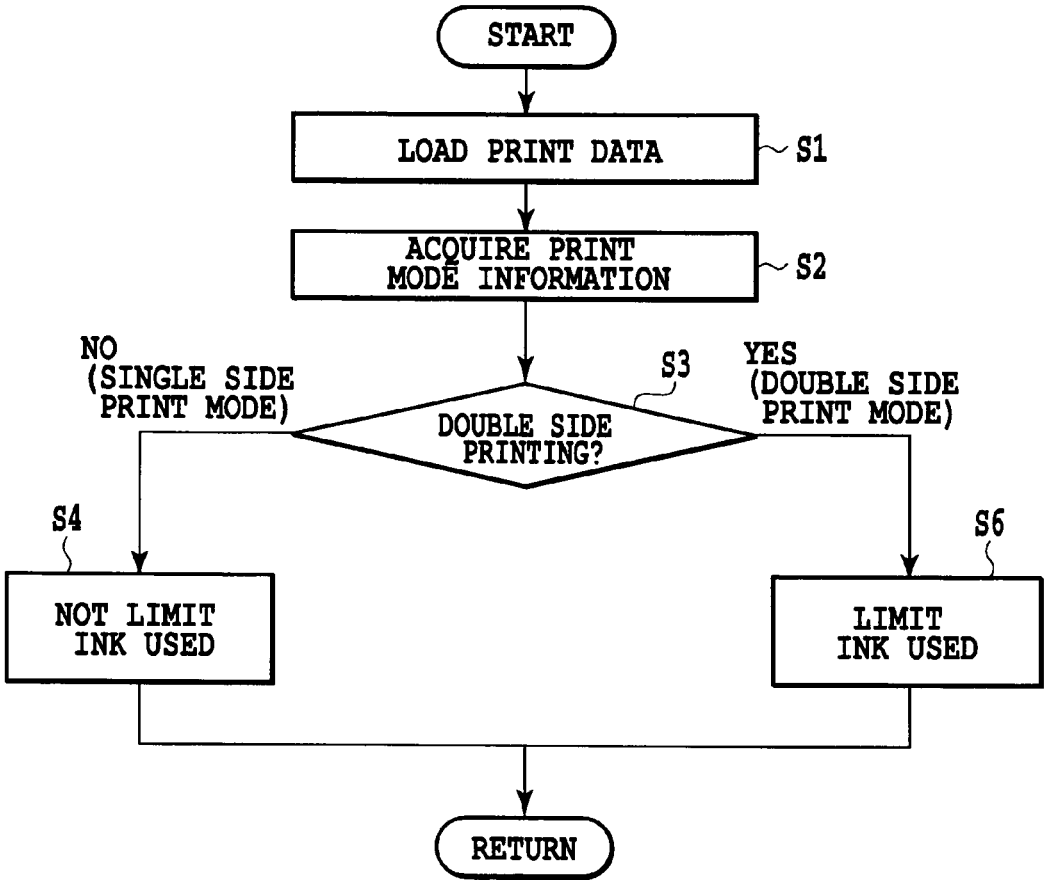
FIG. 8 is a flow chart illustrating a process of setting ink used according to a second embodiment of the present invention.

Specifically, in the double side print mode, any of the settings 2 to 5 in FIG. 7 is selected to properly limit the amount of black pigment ink used. Then, the black dye ink is used to appropriately compensate for an accompanying decrease in optical reflection density with limited amount of black pigment ink used. In the single side print mode, the amount of ink used is not limited as in the case of the above described embodiment. FIG. 8 is a flow chart illustrating a process of setting ink used, for the single print mode and the double side print mode. In the present example, as is apparent from a comparison with FIG. 6 for the previously described embodiment, in the double side print mode, the process proceeds from step S3 to step S6 regardless of whether the first or second printing surface is to be printed. At the step S6, the amount of ink used for printing is limited.

According to the present embodiment, for both front and back sides of the printing medium, the rub-off of the pigment ink can be suppressed. Further, it is unnecessary to change the limitation on the amount of ink used between front side printing and back side printing in the double side print mode. Consequently, control can be simplified.

Third Embodiment

According to the third embodiment, within the same print page for which the double side print mode is set, the amount of ink used is limited in a particular part (particular print area). Specifically, any of the settings 2 to 5 is selected for the particular part within the same page, and an accompanying decrease in optical reflection density is appropriately compensated for by using the black dye ink. The amount of ink used is not limited in the other parts in the double side print mode and in the single side print mode.

Figure 9:
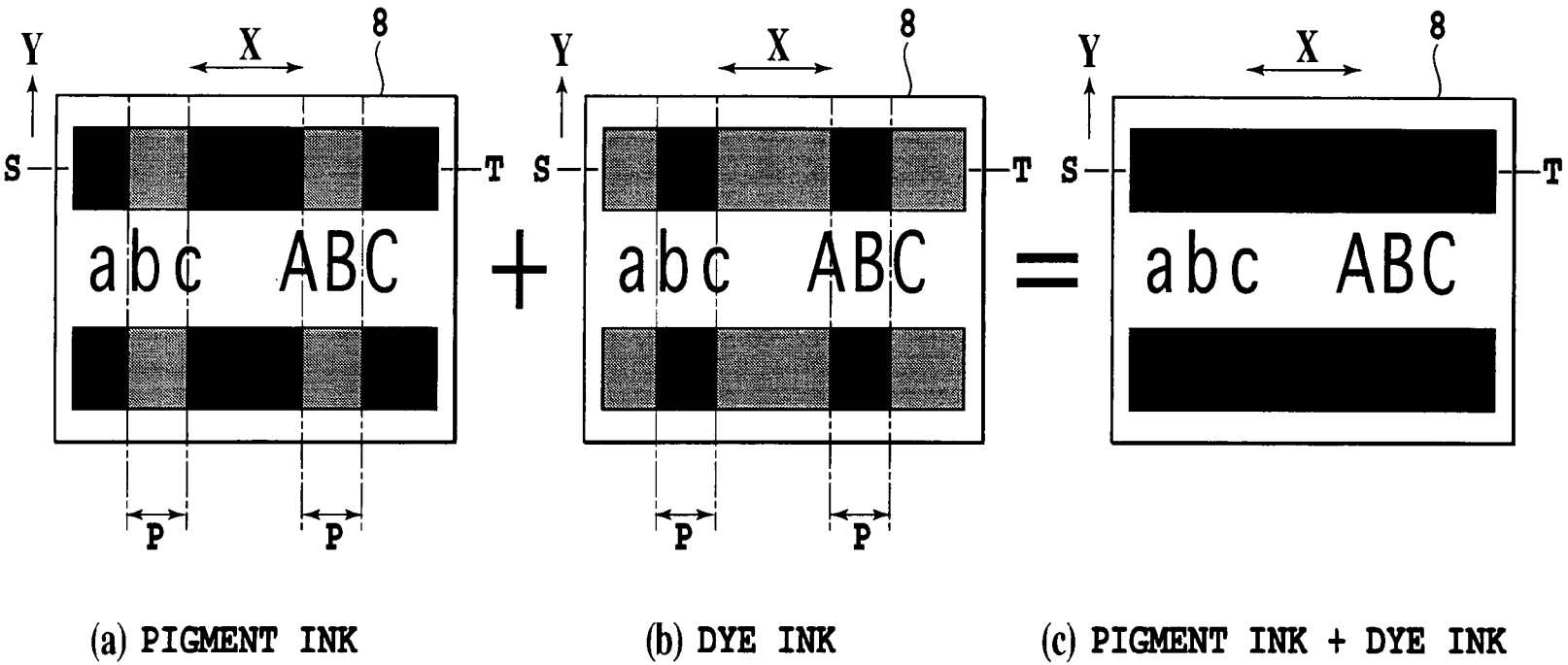
FIG. 9 is a diagram illustrating an example of printing according to a third embodiment of the present invention.

In FIG. 9, the particular part includes two parts P extending on the printing material 8 in the sub-scanning direction (direction of the arrow Y). The amount of ink used is limited for printed images corresponding to the particular parts P. Specifically, for the printed images corresponding to the particular parts P, any of the settings 2 to 5 in FIG. 7 is selected to limit the amount of black pigment ink used. An accompanying decrease in optical reflection density with the limited amount of black pigment ink is appropriately compensated by using the black dye ink. In FIG. 9, the entire printed image is divided into an image (a) printed using the pigment ink and an image (b) printed using the dye ink. Then, these images (a) and (b) are superimposed on each other to form an image (c).

Figure 10:
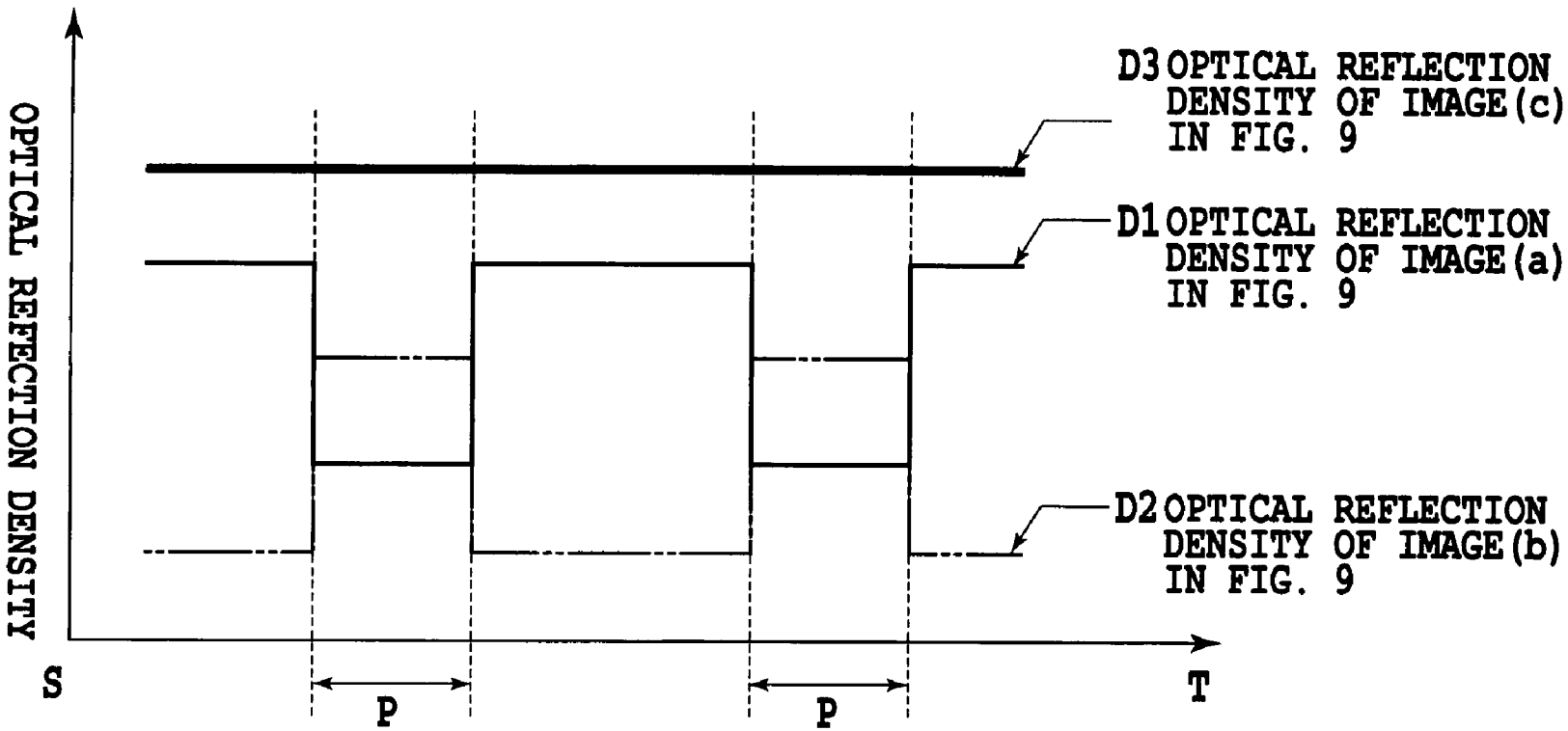
FIG. 10 is a diagram illustrating the optical reflection density of an image on a line S-T in FIG. 9.

FIG. 10 shows the optical reflection densities D1, D2, and D3 of the printed images (a), (b), and (c) on the line S-T in FIG. 9. As can be seen in FIG. 10, for the printed images (a), (b), and (c) corresponding to the particular parts P, the amount of black pigment ink used is limited to reduce the reflection density D1. The black dye ink is used so as to compensate for the reduction, thus increasing the reflection density D2. The resultant reflection density is D3, which is equal to the reflection density of the other parts on the printing material 8.

The particular parts P in the present embodiment can be arbitrarily set in accordance with the internal structure of the printing apparatus. As previously described, in the double side print mode, the front side (first printing surface) of the printing material is first printed, and then the back side (second printing surface) is printed. Accordingly, the automatic reversing device 30 or the like is used to convey the printing material back into the printing apparatus. Thus, the front side of the printing material is rubbed by components of the printing apparatus or automatic reversing device 30. If an image has been printed on the front side using pigment ink, the pigment of the pigment ink may be rubbed off.

Thus, a part of the front side of the printing material which comes into pressure contact with components of the printing apparatus or automatic reversing device 30 is set as the particular part P. The amount of pigment ink used to print the image corresponding to the particular part P is limited to improve the abrasion resistance of the part P. For example, the printing material 8 may contact tightly with the paper presser roller 95 (see FIG. 5) in the automatic reversing device 30 to transfer the pigment ink on its front side to the surface of the paper presser roller 95. In such a case, a part of the front side of the printing material which contacts with the paper presser roller 95 is set as the particular part P. The particular part P can be set regardless of the number of such parts P or its area.

Figure 11:
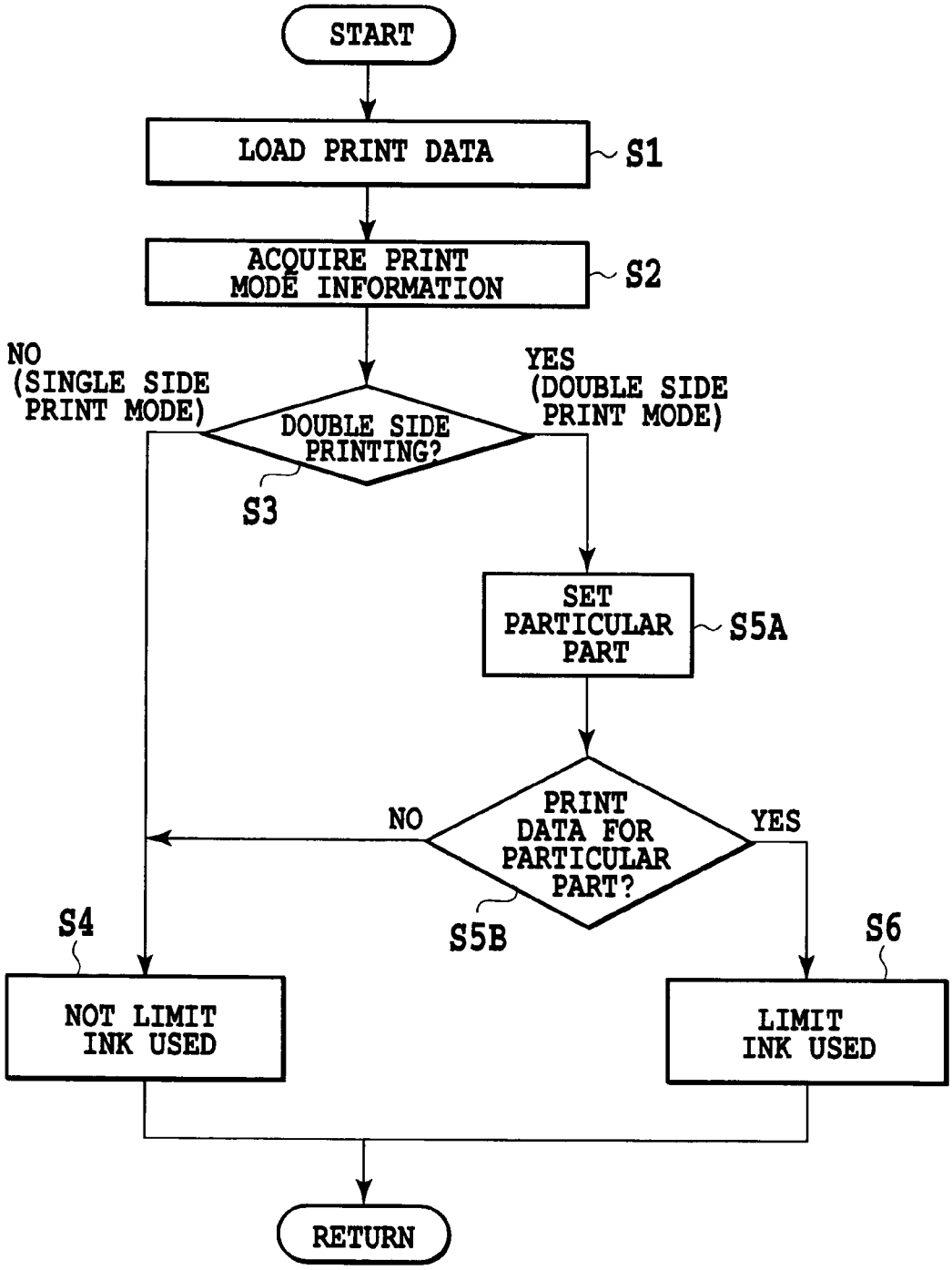
FIG. 11 is a flow chart illustrating a process of setting ink used according to a third embodiment of the present invention.

FIG. 11 is a flow chart illustrating a process of setting ink used, for the single side print mode and the double side print mode. The steps S1 to S4 and S6 are similar to those in FIG. 6 for the previously described embodiment.

In the present example, in the double side print mode, the process proceeds to a step S5A to set the particular part P. The particular part P can be set in order to avoid the degradation of the print grade attributed to the structure of the printing apparatus or automatic reversing device 30 as described above, and also to improve the print grade. Subsequently, at a step S5B, it is determined whether or not the print data is for the particular part P. If the print data is for the particular part P, the amount of ink used to print the print data for the particular part P is limited (step S6). Specifically, as previously described, the amount of black pigment ink used is limited, and an accompanying decrease in the optical reflection density of the printed image, with the limited amount of black pigment ink used, is compensated by using the black dye ink. In this case, dye inks in other colors are desirably used together with the black dye ink provided that this improves the print grade. On the other hand, if the print data is for an area other than the particular part P, the process proceeds to the step S4. Then, the amount of ink used for the printing is not limited.

In the present embodiment, even during double side printing, images can be printed while making the most of pigment ink and avoiding the degradation of the print grade.

Fourth Embodiment

Figure 12:
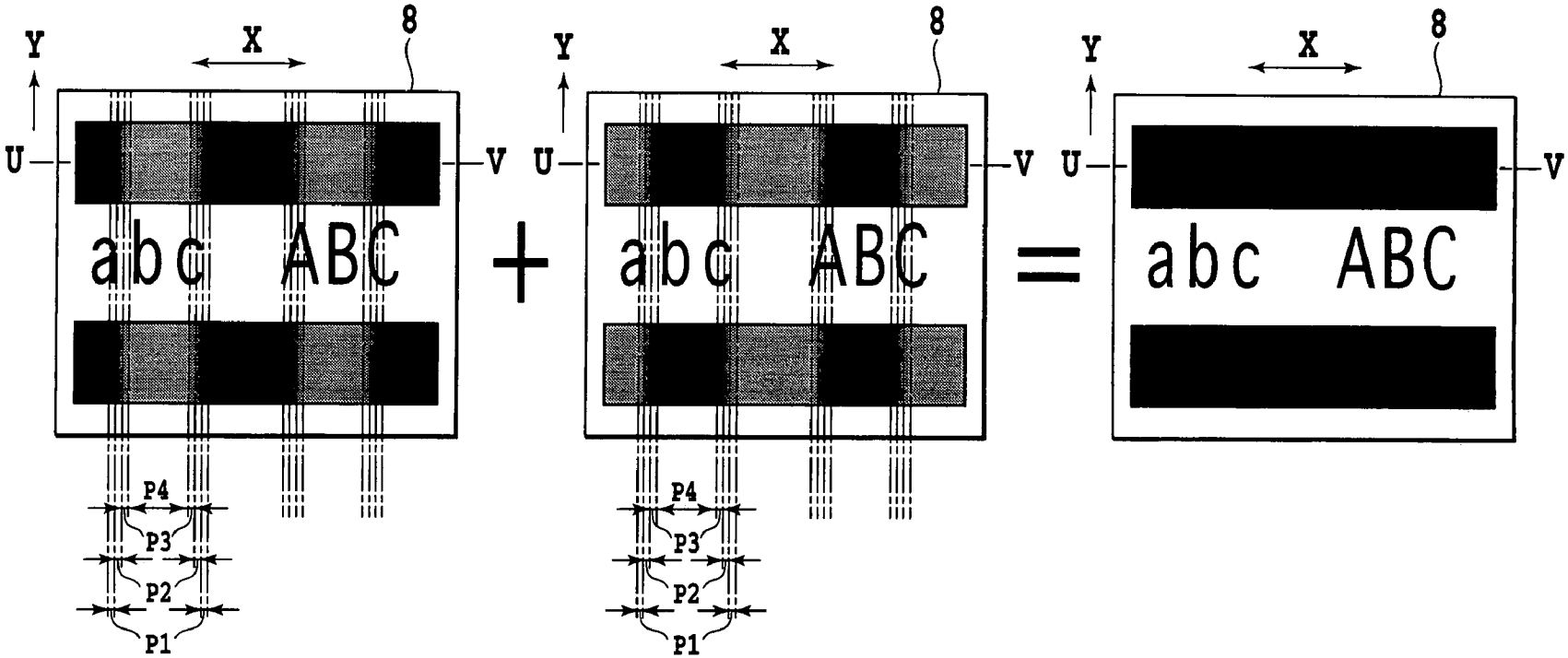
FIG. 12 is a diagram illustrating an example of printing according to a fourth embodiment of the present invention.

In the present embodiment, as shown in FIG. 12, the amount of ink used is limited step by step in a plurality of adjacent particular parts P1, P2, P3, and P4. The ratio of the amount of pigment ink mainly used to the amount of dye ink used is varied step by step.

Figure 13:
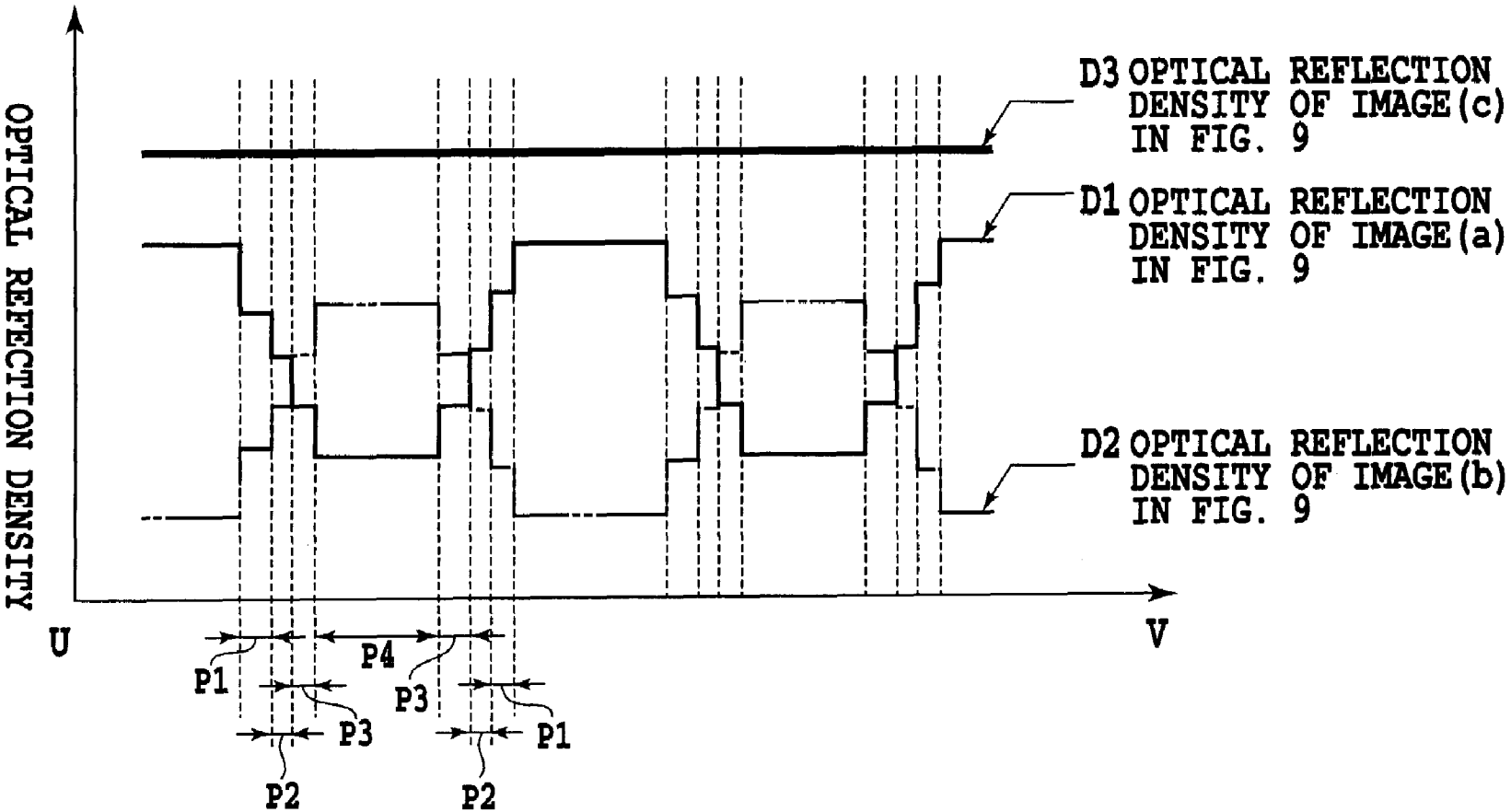
FIG. 13 is diagram illustrating the optical reflection density of an image on a line U-V in FIG. 12.

In FIG. 12, the entire printed image is divided into an image (a) printed using the pigment ink and an image (b) printed using the dye ink. Then, these images (a) and (b) are superimposed on each other to form an image (c). FIG. 13 shows the optical reflection densities D1, D2, and D3 of the printed images (a), (b), and (c) on the line U-V in FIG. 12. As can be seen in FIG. 13, for the printed images corresponding to the particular parts P1, P2, P3, and P4, the amount of black pigment ink used is limited to reduce the reflection density D1 step by step. The black dye ink is used so as to compensate for the reduction, thus increasing the reflection density D2 step by step. The resultant reflection density is D3, which is equal to the reflection density of the other parts on the printing material 8.

The ratio of the amount of pigment ink used to the amount of dye ink used in the particular parts P1, P2, P3, and P4 can be set at four values between the settings 1 and 5 in FIG. 7. This obscures the boundaries between the particular parts P1, P2, P3, and P4 and between each of these particular parts and a different part to improve the print grade.

Other Embodiments

In the description of the above embodiments, the pigment and dye ink in the same color are in black. However, the present invention is applicable to printing of an image using pigment and dye inks in the same color which is different from black. That is, at least in the double side print mode, the amount of pigment ink used and having a color different from black can be limited in a part (particular part) of the first printing surface. Then, an accompanying decrease in the optical reflection density of the printed image, with the limited amount of pigment ink used and having the color different from black, can be compensated by using a dye ink in the same color. In this manner, the present invention is applicable to apparatuses, methods, and programs which enable double side printing using pigmented and dye inks in the same color for at least one color.

The effects of the present invention are more significant on printing of a letter. The message and address sides of a letter have distinct applications. Accordingly, by setting the address side as the second printing surface, it is possible to obtain a high print grade suitable for the application of each side. In this case, the message side, the second printing surface, is not contaminated. Clear, thick, and sharp letters are desirably written on the address side or the like on which the address and name of an individual are written. Thus, the pigment ink is preferably used on this side. The dye inks are preferably used on the message side or the like on which a mixture of a photograph and an illustration of a high definition are printed. By setting the message side as the first printing surface and the address side as the second printing surface, the present invention can provide a high print grade suitable for the application of each side.

The double side print mode in which the amount of ink used is limited may be specified using a UI (User Interface) of a printer driver of the host device 110, connected to the printing apparatus, instead of the input section of the printing apparatus.

If the double side print mode is specified using the UI (User Interface) of the printer driver of the host device 110, the host device preferably creates data compatible with the double side print mode and send the created data to the printing apparatus. For example, the printer driver of the host device 110 creates ejection data on the black pigment and dye inks so that the amount of black pigment ink used is limited and that an accompanying decrease in the print density, with limited amount of black pigment ink used, is compensated by using the black dye ink.

The present invention is not limited to the above described serial scan type printing apparatus but is widely applicable to various printing apparatuses including what is called a full line type that uses a print head extending over the entire width of a print area in a printing medium. Further, the present invention is widely applicable to various printing apparatuses that print an image on a printing medium using plural types of inks including at least pigment and dye inks in the same color as well as a plurality of print modes including the double side print mode.

The functions of the previously described embodiments of the present invention may be provided by directly or remotely supplying the system or apparatus with a program (in the embodiments, the program corresponding to the flowcharts shown in the figures) for software that implements the functions of the embodiments and causing a computer in the system or apparatus to read and execute the supplied program codes. In this case, what has the functions of such a program need not be a program.

Therefore, the program code itself installed in the computer to allow the computer to implement the functions and processes of the present invention can also implement the present invention. That is, the present invention includes the computer program itself for implementing the functions and processes of the present invention.

In this case, the program may take any form including an object code, a program executed by an interpreter, or script data supplied to an OS provided that it has the functions of the program.

A storage medium used to supply the program code may be, for example, a floppy (registered trade mark) disk, a hard disk, an optical disk, a magneto optic disk, an MO, a CD-ROM, a CD-R, a CD-RW, a magnetic tape, non-volatile memory card, a ROM, or a DVD (DVD-ROM or DVD-R).

The program can also be supplied by using a browser in a client computer to connect to the appropriate home page on the Internet and downloading the computer program itself of the present invention or a compressed file containing an automatic installing function, from that home page into a storage medium such as a hard disk. Alternatively, the program code constituting the program of the present invention may be divided into a plurality of files so that the files can be downloaded from the respective home pages. That is, the present invention includes a WWW server that allows a plurality of users to download the program files that cause the computer to implement the functions and processes of the present invention.

It is also possible to cipher the program of the present invention, store the ciphered program in a storage medium such as a CD-ROM, distribute the program to users, and allow users who have met predetermined conditions to download key information required for deciphering, from the corresponding home page via the Internet so that the users can use the key information to execute the ciphered program to cause the computer to install the program.

The present invention is not limited to the implementation of the functions of the previously described embodiments based on the execution of the program code read by the computer. For example, of course, the OS (Operating System) operating on the computer may execute a part or the whole of the actual process, so that the process serves to implement the functions of the previously described embodiments.

Moreover, of course, the program code read from the storage medium may be written in a memory provided in an expanded board inserted into the computer or in an expanded unit connected to the computer. Then, on the basis of instructions in the program code, a CPU or the like provided in the expanded board or unit may execute a part or the whole of the actual process, so that the process serves to implement the functions of the previously described embodiments.

The present invention has been described in detail with respect to preferred embodiments, and it will now be apparent from the foregoing to those skilled in the art that changes and modifications may be made without departing from then invention in its broader aspects, and it is the intention, therefore, that the appended claims cover all such changes and modifications as fall within the true spirit of the invention.

What is claimed is:

1. A printing apparatus capable of printing an image on a printing medium by using at least black pigment ink and black dye ink, the apparatus comprising:

a selecting unit that selects either a single side print mode in which one side of the printing medium is printed or a double side print mode in which both sides of the printing medium are printed; and print control means that executes a process for printing by using a first amount of the black pigment ink without using the black dye ink based on black image data to express a predetermined density level when the single side print mode is selected by said selecting unit, and that executes a process for printing by using a second amount of the black pigment ink and a third amount of the black dye ink based on the black image data to express the predetermined density level when the double side print mode is selected by said selecting unit, the second amount being less than the first amount.

2. A printing apparatus according to claim 1, wherein when the double side print mode is selected by said selecting unit, the process is executed for only one of both surfaces of the printing medium, the only one surface being first printed.

3. A printing apparatus according to claim 1, wherein when the double side print mode is selected by said selecting unit, the process is executed for both surfaces of the printing medium.

4. A printing apparatus according to claim 1, wherein the printing apparatus is capable of printing using a cyan dye ink, a magenta dye ink, and a yellow dye ink.

5. A printing method for printing an image on a printing medium by using at least black pigment ink and black dye ink, the method comprising:

a selecting step of selecting either a single side print mode in which one side of the printing medium is printed or a double side print mode in which both sides of the printing medium are printed; and a printing step of (i) printing a black image by using the black pigment ink without using the black dye ink based on black image data to express a predetermined density level when the single side print mode is selected in said selecting step, and (ii) printing a black image by using an amount of the black pigment ink less than an amount of the black pigment ink used in the single side print mode and using the black dye ink based on the black image data to express the predetermined density level when the double side print mode is selected in said selecting step.

6. A printing method according to claim 5, wherein when the single side print mode is selected in said selecting step, in said printing step, the black image is printed by using a first amount of the black pigment ink, and when the double side print mode is selected in said selecting step, in said printing step, the black image is printed by using a second amount of the black pigment ink and using a third amount of the black dye ink, the second amount being less than the first amount.

7. A printing apparatus, comprising:

a print head that ejects at least black pigment ink and black dye ink; and a print controller configured to execute a single side print mode in which one side of a printing medium is printed by using the print head and a double side print mode in which both sides of the printing medium are printed by using the print head, wherein a black image is printed based on black image data to express a predetermined density level by using the black pigment ink without using the black dye ink in the single side print mode, and a black image is printed based on the black image data to express the predetermined density level by using an amount of the black pigment ink less than an amount of the black pigment ink used in the single side print mode and the black dye ink in the double side print mode.

8. A data processing method for executing data processing to print an image on a printing medium by using at least black pigment ink and black dye ink, the method comprising:

a determining step of determining whether a print mode to be executed is a single side print mode in which one side of the printing medium is printed or a double side print mode in which both sides of the printing medium are printed; and an executing step of executing a first data processing to print by using a first amount of the black pigment ink without using the black dye ink based on black image data to express a predetermined density level if the single side print mode is executed, and executing a second data processing to print by using a second amount of the black pigment ink and a third amount of the black dye ink based on the black image data to express the predetermined density level if the double side print mode is executed, the second amount being less than the first amount.

* * * * *